United States Patent [19]

Lardner

[11] Patent Number: 4,534,407

[45] Date of Patent: Aug. 13, 1985

[54] HEAT EXCHANGERS

[75] Inventor: Graham G. Lardner, Llanelli, Wales

[73] Assignee: Unipart Group, Limited, Cowley, England

[21] Appl. No.: 527,810

[22] Filed: Aug. 30, 1983

[30] Foreign Application Priority Data

Sep. 3, 1982 [GB] United Kingdom ..... 8225112
Apr. 14, 1983 [GB] United Kingdom ..... 8310087

[51] Int. Cl.[3] ..... F28F 7/00
[52] U.S. Cl. ..... 165/81; 165/149
[58] Field of Search ..... 165/81, 149

[56] References Cited

U.S. PATENT DOCUMENTS

| | | | |
|---|---|---|---|
| 1,834,001 | 12/1931 | Modine | 165/149 X |
| 2,933,291 | 4/1960 | Huggins | 165/149 X |
| 3,165,151 | 1/1965 | Astrup et al. | 165/81 |
| 3,627,035 | 12/1971 | Astrup | 165/149 X |
| 3,960,210 | 6/1976 | Chartet | 165/81 X |
| 4,137,982 | 2/1979 | Crews et al. | 165/149 X |

FOREIGN PATENT DOCUMENTS

| | | | |
|---|---|---|---|
| 2036696 | 2/1969 | France | 165/81 |
| 2183374 | 5/1972 | France | 165/81 |
| 2494828 | 11/1980 | France . | |
| WO79/00960 | 11/1979 | PCT Int'l Appl. | 165/81 |
| 1443725 | 8/1973 | United Kingdom | 165/81 |
| 1461638 | 4/1974 | United Kingdom | 165/81 |

*Primary Examiner*—William R. Cline
*Assistant Examiner*—Peggy A. Neils
*Attorney, Agent, or Firm*—Thomas J. Greer, Jr.

[57] ABSTRACT

A heat exchanger such as a motor vehicle radiator of the tube 5 and corrugated fin 6 type has clamping members 7 to hold the fin and tube matrix together to resist outward pressure pulsations. The clamping members are located in position by means of arms 9 which are rigidly connected to the rim 8 of a tube plate into which the tubes 5 are connected, or to any other part of the respective header tank. Sliding movement is permitted between the arms 9 and clamping members 7, so that differential thermal expansion between the clamping members 7 and the tubes 5 which have liquid running through them is taken up by the relative movement of the arms 9 and the clamping members 7. Because the clamping members 7 are of uniform section, and are not directly shaped to be secured to the header tanks, lower tooling costs are possible.

3 Claims, 8 Drawing Figures

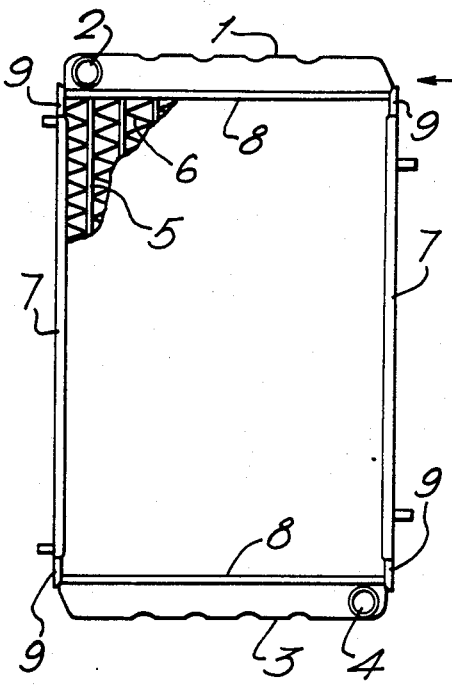
FIG.1.
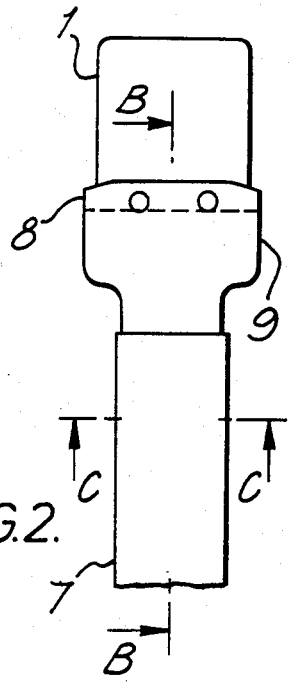
FIG.2.
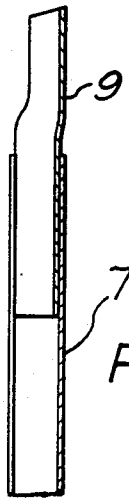
FIG.3.
FIG.4.
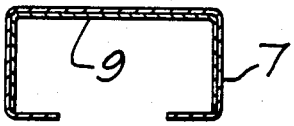

HEAT EXCHANGERS

This invention relates to heat exchangers, especially to those suitable for use in vehicle cooling systems.

Such heat exchangers comprise a pair of header tanks, a plurality of tubes extending between the header tanks and airways located between the tubes, and clamping members parallel to the tubes on each side of the matrix. The clamping members serve to resist expansion of the matrix under pressure pulsations in the tubes in use. They are sometimes rigidly connected to the header tanks so that they can perform this function.

This, however, causes problems since the tubes expand as the cooling fluid heats up but the clamping member does not, or at least not to the same extent. Consequently, the tube plate, that it, the part of the header tank into which the tubes pass, is stressed towards the regions adjacent to the clamping members.

The invention provides a heat exchanger which comprises a pair of header tanks, a plurality of tubes extending between the header tanks and airways located between the tubes, clamping members parallel to the tubes on each side of the matrix, and a pair of arms rigidly connected two ends of each header tank, which arms so engage the clamping members that each clamping member is held in contact with the matrix but each arm can slide relative to the associated clamping member in a direction parallel to the tubes.

With this arrangement, the clamping members can still clamp the matrix together, but the sliding movement ensures that the outer regions of the tube plate are not stressed despite the differential thermal expansion.

Advantageously, each clamping member is shorter than the tubes. Such a clamping member can also hold the matrix together in the typical matrix making machine, which is such that nothing longer than the tubes can be accommodated.

Two heat exchangers (radiators) for the engine cooling system of a motor vehicle, constructed in accordance with the invention, will now be described by way of example with reference to the accompanying drawings, in which:

FIG. 1 is a front view of a first heat exchanger;

FIG. 2 is an enlarged view of the heat exchanger taken in the direction of the arrow A;

FIG. 3 is a section through lines B—B of FIG. 2;

FIG. 4 is a section through lines C—C of FIG. 2;

Like reference numerals have been given to like parts throughout all the Figures.

Figure 5:
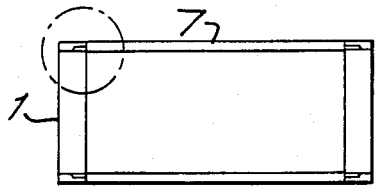
FIG. 5 is a view of the second heat exchanger.
Figure 6:
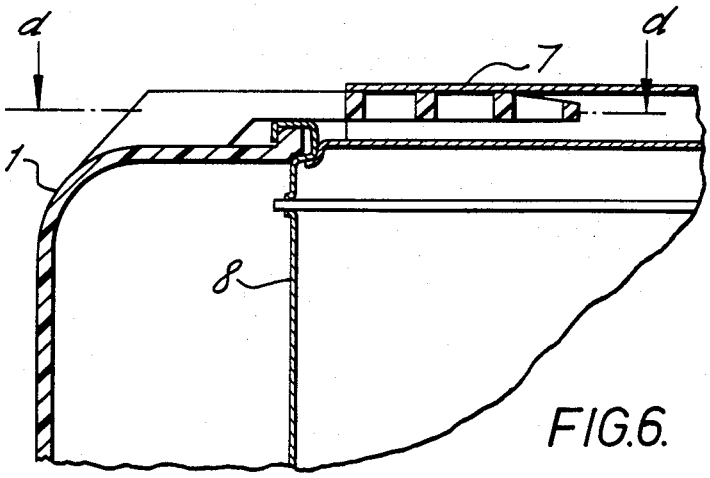
FIG. 6 is an enlarged view showing the expansion joint of the second heat exchanger.
Figure 7:
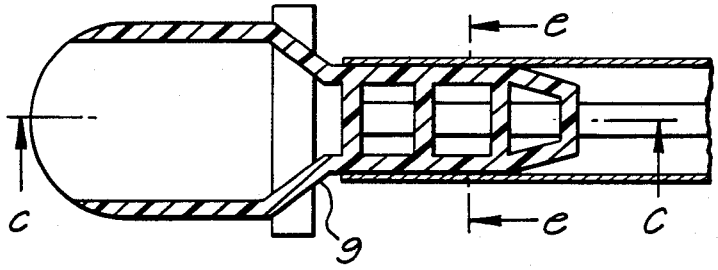
FIG. 7 is a section through the lines d—d of FIG. 6.

The first heat exchanger comprises a top header tank 1 having an outlet 2 and a bottom header tank 3 having an inlet 4. Tubes 5 run between the header tanks and are interspersed with airways 6 consisting of a metal strip in zig-zag form. The matrix of tubes and airways is clamped together at the side by means of two clamping members 7.

Each header tank is closed on the side nearest to the matrix by a plate, called a tube plate, into which the ends of the tubes 5 are soldered. Each tube plate has an upturned rim. The rim for the tube plate for the upper header tank is identified by the reference numeral 8. The tubes 5 themselves are flattened in section.

In manufacture of the radiator, the tube and airway matrix is assembled between the two clamping members (held together by suitable means, for example, one or more ties of the form described and claimed in our co-pending United Kingdom Patent Application No. 82 20954) in a machine. The tubes 5 are pre-coated with solder. The matrix including the clamping members 7 is then baked and in this way the tubes are soldered to the airways. The tube plates and shells of the header tanks are only fitted in position once this assembly has been built up. First, arms 9 are rivetted to the rim 8 of the upper tube plate, and similar arms are rivetted to the lower tube plate in the same way. When the tube plate 8 is placed over the ends of the tubes 5, care is taken to ensure that the arms 9 are inserted into the clamping members 7.

It will be seen from FIGS. 2 to 4 that each arm is of channel section, but has a part with a relatively wide base and shallow sides where it attaches to the tube plate and a part with a narrower base and deeper sides where it engages the clamping member. It will also be seen that the clamping member is of box section, although the box is not continuous. When the tube plates have been soldered to the tubes 5, the exterior of the lower parts of the arms 9 is in sliding fit with the interior of the clamping members 7 and the clamping members 7 are positively located against movement in the direction of the length of the tube plate. The clamping members 7 are thus held in a position where they clamp the matrix together.

In use of the radiator, pressure pulsations in the cooling system will case outward forces to develop on the clamping members 7, but these will be resisted by the clamping members by virtue of their connection via the arms 9 to the tube plates 8. The arrangement of the invention also has the advantage that differential thermal expansion between the clamping members 7 and the tubes 5 (the latter having liquid passing through them and the former not) will be taken up simply by sliding movement between the arms 9 and the clamping members 7. In this way stresses will be avoided on the tube plate and tubes 5 in the region of their ends which would occur if, as in some prior constructions, the clamping members 7 were welded directly, or rivetted directly, to the tube plates 8.

A further advantage is that the clamping members 7, being shorter than the tubes 5, can be accomodated in a conventional matrix forming machine. Previously it was necessary in some constructions of radiator to form a clamping member in two parts, an inner one which could fit the matrix making machine and an outer one with specially shaped ends which would be secured directly to the tube plates. Obviously this called for two parts instead of one in accordance with the invention, but also special tooling for the outer part for each shape of radiator. The simple clamping member 7 can be rolled and can be cut to any desired length, and tooling costs for the radiator of the present invention are thereby significantly reduced.

If desired, instead of the arms 9 being rivetted to the rim 8 of the tube plates, they may be welded thereto, and the rivetting and welding may if desired be done directly to the remainder of the headed tank.

In the second embodiment, referring to FIGS. 5 to 8, the shells of the header tanks are of plastics material.

They are closed by tube plates 8 as in the first embodiment.

Figure 8:
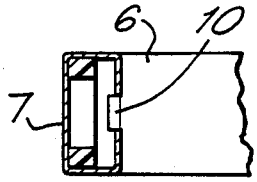
FIG. 8 is a section through the lines e—e of FIG. 7.

The moulding of the shells is extended at the ends into the arms 9 which engage in the clamping members 7 as in the first embodiment. In addition to the advantages noted for the first embodiment, this serves to protect the joint of the plastics shell to the tube plate 8, that is, if the shell is inadvertently knocked, the arms 9 take up some of the force rather than all the strain being taken by the shell/tube plate joint. The moulding of the header tank and arms can be done in one piece. In FIG. 8, as an additional aid in holding the clamping members relative to the rest of the matrix before baking in the oven, the airways 6 have a projection 10 which engages with the clamping member to locate the clamping member 7 against movement at right-angles to the plane of the radiator. This engagement of the airways and clamping member 7 can be achieved in alternative ways.

I claim:

1. A heat exchanger, said heat exchanger comprising a pair of header tanks formed from a plastic material and having axially rigid arms molded integrally therewith; a matrix including a plurality of tubes extending between the header tanks and airways located between the tubes, and clamping members which are substantially box-shaped in cross-section disposed parallel to the tubes on each side of the matrix; said axially rigid arms extending into the clamping members and having a telescoped sliding fit thereon whereby each clamping member is in contact with the matrix but each of the arms can slide relative to its associated clamping member in a direction parallel to the tubes.

2. A heat exchanger as claimed in claim 1, wherein each clamping member is shorter than the tubes.

3. A heat exchanger as claimed in claim 1 wherein said clamping members are generally box-shaped in cross-section and have a plurality of walls, and those portions of said arms extending into said clamping member are engaged with said clamping member walls remote from said matrix.

* * * * *